US006652742B2

(12) United States Patent
Henkin et al.

(10) Patent No.: US 6,652,742 B2
(45) Date of Patent: Nov. 25, 2003

(54) AUTOMATIC POOL CLEANER SYSTEM UTILIZING ELECTRIC AND SUCTION POWER

(76) Inventors: Melvyn L. Henkin, 1001 Sharon La., Ventura, CA (US) 93001; Jordan M. Laby, 1389 Beachmont, Ventura, CA (US) 93001

( * ) Notice: Subject to any disclaimer, the term of this patent is extended or adjusted under 35 U.S.C. 154(b) by 19 days.

(21) Appl. No.: 10/133,004

(22) Filed: Apr. 26, 2002

(65) Prior Publication Data

US 2003/0201218 A1 Oct. 30, 2003

Related U.S. Application Data

(63) Continuation of application No. PCT/US00/31156, filed on Nov. 14, 2000.

(51) Int. Cl.[7] ..... E04H 4/16

(52) U.S. Cl. ..... 210/169; 210/416.2; 15/1.7; 4/490

(58) Field of Search ..... 210/169, 416.2; 15/1.7; 4/490

(56) References Cited

U.S. PATENT DOCUMENTS

| | | | | |
|---|---|---|---|---|
| 4,154,680 A | | 5/1979 | Sommer | |
| 4,835,809 A | | 6/1989 | Roumagnac | |
| 4,837,886 A | | 6/1989 | Rawlins | |
| 4,849,024 A | | 7/1989 | Supra | |
| 5,197,158 A | | 3/1993 | Moini | |
| 5,337,434 A | | 8/1994 | Erlich | |
| 5,435,031 A | | 7/1995 | Minami | |
| 5,985,156 A | | 11/1999 | Henkin et al. | |
| 6,039,886 A | | 3/2000 | Henkin et al. | |
| 6,090,219 A | | 7/2000 | Henkin et al. | |
| 6,280,611 B1 | * | 8/2001 | Henkin et al. | 210/143 |
| 6,294,084 B1 | * | 9/2001 | Henkin et al. | 210/143 |
| 6,365,039 B1 | * | 4/2002 | Henkin et al. | 210/103 |
| 6,387,250 B1 | * | 5/2002 | Henkin et al. | 210/97 |
| 6,485,638 B2 | * | 11/2002 | Henkin et al. | 210/143 |

* cited by examiner

*Primary Examiner*—Fred G. Prince
(74) *Attorney, Agent, or Firm*—Freilich, Hornbaker & Rosen

(57) ABSTRACT

An automatic pool cleaning system employing a unitary body configured to move through a pool to collect debris from adjacent to the pool containment wall surface and/or the pool water surface and more particularly to such systems which utilize electric power for propulsion and/or cleaning in combination with water suction power for cleaning and/or propulsion and/or electric generation.

44 Claims, 15 Drawing Sheets

AUTOMATIC POOL CLEANER SYSTEM UTILIZING ELECTRIC AND SUCTION POWER

RELATED APPLICATIONS

This application is a continuation of international application PCT/US00/31156 filed on Nov. 14, 2000 that claims a priority date of Nov. 15, 1999 based on U.S. application Ser. 09/440,109 (now, U.S. Pat. No. 6,294,084).

FIELD OF THE INVENTION

This invention relates to a method and apparatus for automatically cleaning a water pool, e.g., a swimming pool.

BACKGROUND OF THE INVENTION

The prior art is replete with different types of automatic swimming pool cleaners. They include water surface cleaning devices which typically float at the water surface and can be moved across the water surface for cleaning, as by skimming. The prior art also shows pool wall surface cleaning devices which normally rest at the pool bottom but, which can be activated to move along the containment wall surface (which term should be understood to include primarily horizontal bottom and side primarily vertical portions) for wall cleaning, as by vacuuming and/or sweeping. Some prior art assemblies include both water surface cleaning and wall surface cleaning components tethered together.

Applicants' U.S. Pat. No. 5,985,156 describes apparatus including a unitary body having (1) a level control subsystem for selectively moving the body to a position either proximate to the surface of the water pool or proximate to the interior surface of the containment wall, (2) a propulsion subsystem operable to selectively propel the body in either a forward or rearward direction, and (3) a cleaning subsystem operable in either a water surface cleaning mode (e.g., skimming or scooping) or a wall surface cleaning mode (e.g., vacuuming or sweeping). U.S. Pat. No. 5,985,156 discloses that these subsystems can be powered by hydraulic, pneumatic, or electric power sources and specifically describes hydraulic embodiments powered by positive and negative water pressure. Applicants' U.S. Pat. Nos. 6,090,219 and 6,039,886 describe preferred cleaning systems powered by positive water pressure and negative water pressure (suction), respectively. The disclosures in applicants' aforecited US patents are incorporated herein by reference.

SUMMARY OF THE INVENTION

The present invention is directed to automatic pool cleaning systems employing a unitary body configured to move through a pool to collect debris from adjacent to the pool containment wall surface and/or the pool water surface and more particularly to such systems which utilize electric power for propulsion and/or cleaning in combination with water suction power for cleaning and/or propulsion and/or electric generation.

Embodiments of the present invention are configured to derive electric power from either an onboard source or an external source. The onboard source can include a solar cell, an electric generator and/or a battery which can be charged from the solar cell or generator. Alternatively, the battery can be charged by causing the body to visit a charging station adjacent to the wall. The external source can comprise an electric wire extending to the body from the wall.

The body is preferably supported on some type of traction means, e.g., wheels. The electric power is used to drive an onboard electric motor to drive the traction means and/or a flow generator for propelling the body and/or cleaning. In addition to including electric propulsion means, preferred embodiments of the invention can also include an electrically powered steering means to facilitate movement of the body throughout the entire pool.

Embodiments of the present invention can be configured for cleaning operation either (1) solely adjacent to the wall or water surface or (2) selectively adjacent to the wall surface or adjacent to the water surface. Embodiments which are selectively operable adjacent to either the wall surface or water surface include a level control subsystem for producing a vertical force to cause the body to either ascend to the water surface or descend to the wall surface. In accordance with a preferred embodiment, the level control subsystem operates to selectively modify the buoyancy of the body, e.g., by filling or exhausting onboard air bags or expanding and compressing onboard air utilizing an electrically powered pump.

Embodiments of the invention can use either a heavier-than-water body or a lighter-than-water body. When a heavier-than-water body is used, the body in its quiescent or rest state typically sinks to the bottom portion of the pool containment wall. In an active state, the level control subsystem produces a vertical force component for lifting the body to the water surface. When a lighter-than-water body is used, the body in its quiescent state floats at a position proximate to the water surface. In an active state, the level control subsystem produces a vertical force component for causing the body to descend to the wall bottom portion. Embodiments of the invention are preferably configured to return the body to its quiescent state when electric power is terminated, whether by normal shut down or onboard by power depletion.

Embodiments of the present invention also employ a suction hose extending from a water outlet on the body to the pool wall for coupling the outlet to a water suction source, typically comprising the suction side of a main pool pump. The body defines a water flow path coupling one or more water inlets to the water outlet. The suction source functions to draw pool water (and water borne debris) into an inlet for passage through the flow path, outlet, and hose to the main pool pump and filter. A lower water inlet is located on the body in a position to collect water and debris from adjacent to the wall surface. An upper inlet can be located in a position to collect water and debris from adjacent to the water surface.

The aforementioned body outlet includes a hose fitting for coupling to the distal end of a suction hose. The hose fitting is preferably mounted to enable the orientation of the fitting (and the end of the suction hose coupled thereto) to be varied relative to the body. By varying the orientation of the hose fitting, the direction of drag forces on the body attributable to the hose will also vary to thereby increase the likelihood that the body will randomly traverse the entire pool area rather than being restricted to only a portion thereof. Moreover, to achieve even better pool area coverage, a steering means, e.g., electric motor, is preferably provided to continually or periodically vary the orientation of the hose fitting. In one disclosed embodiment, the hose fitting is mounted for pivotal positioning about an essentially vertical axis.

In an alternative embodiment, the fitting is mounted for pivotal positioning about an essentially horizontal axis. In this case, the fitting is moved to a first orientation for operation in the wall surface cleaning mode and to a second orientation for operation in the water surface cleaning mode. The respective orientations can be used to operate a valve to achieve optimum suction flows through the lower and upper inlets for cleaning in the respective wall surface and water surface modes.

In accordance with a still further feature of a preferred embodiment, redirect or repositioning means are preferably provided to facilitate extricating the body from situations in which it could get trapped behind an obstruction (e.g., ladder, steps, etc.) in the pool. A simple but effective repositioning technique utilizes the aforementioned steering means. That is, in addition to using the steering means to rotate the body through a normal range (i.e., minor arc) to achieve full pool coverage, the steering means can be selectively commanded to rotate the body by a more extreme degree (i.e., major arc) to move the body in a second direction different from the first direction normally induced by the propulsion means. Alternative repositioning techniques involve discharging a water flow having sideward and/or rearward thrust components, or twisting or tugging the suction hose to exert a force on the body.

In accordance with a still further feature of a preferred embodiment, an electrically driven flow generator, e.g., propeller, is provided on the body to generate a water flow to facilitate propulsion and/or steering/repositioning and/or cleaning.

In accordance with a further alternative arrangement, a turbine is mounted in the body so as to be driven by a suction flow between a water inlet and outlet. The turbine can be used to drive the propulsion means and in addition to drive an electric generator useful, e.g., for charging an onboard battery. The battery can drive a motor to assist in driving the propulsion means.

Embodiments of the invention preferably also include an onboard electronic controller for controlling the functioning (e.g., on, off, duration, etc.) of the aforementioned subsystems.

DETAILED DESCRIPTION

Figure 1A:
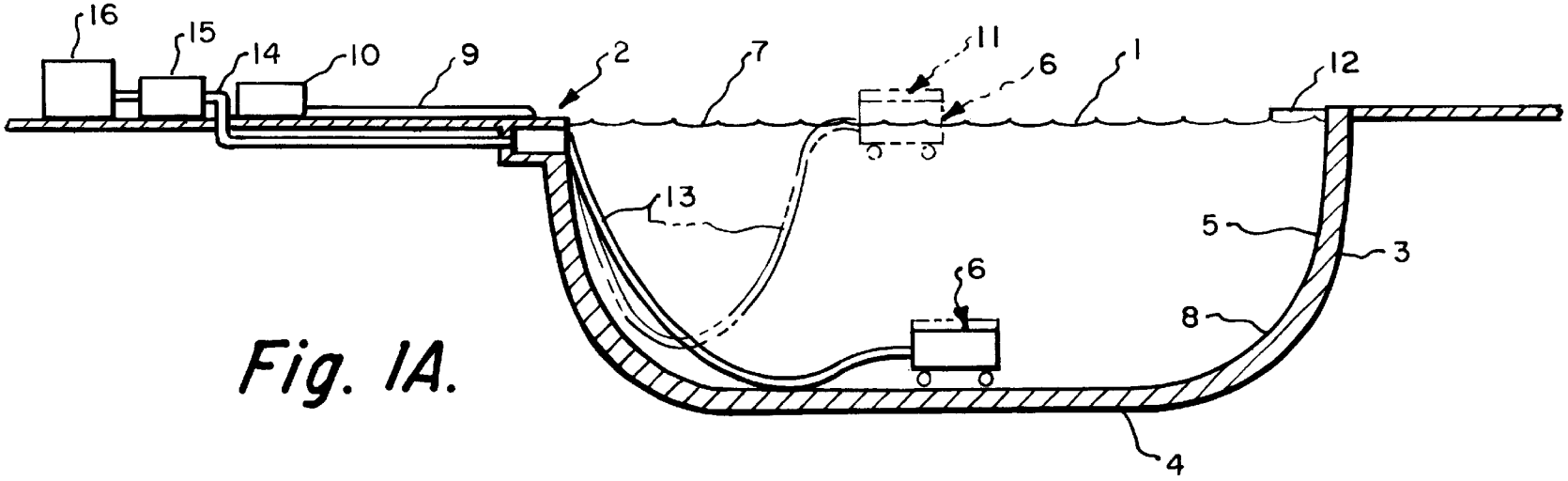
FIGS. 1A and 1B respectively schematically depict electrically propelled heavier-than-water and lighter-than-water cleaner embodiments coupled to a suction hose.
Figure 1B:
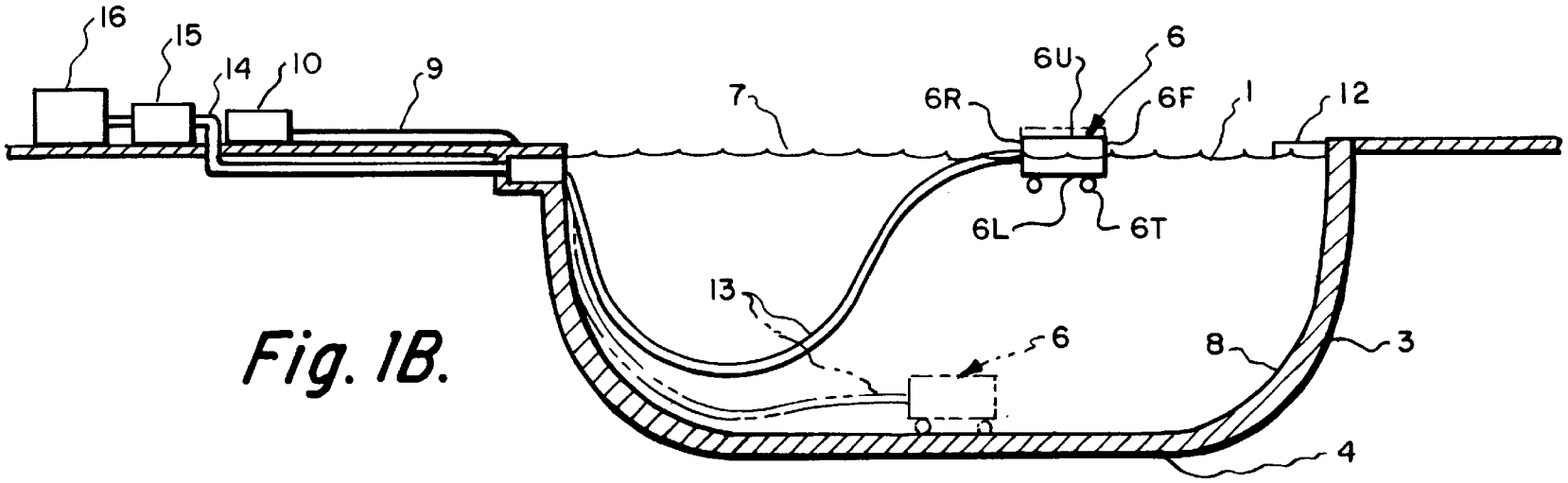

With initial reference to FIGS. 1A and 1B, the present invention is directed to a method and apparatus for cleaning a water pool 1 contained in an open vessel 2 defined by a containment wall 3 having bottom 4 and side 5 portions. Embodiments of the invention utilize a unitary structure or body 6 capable of traversing the water pool 1, for cleaning either (1) solely proximate to the wall surface 8 or water surface 7 or (2) selectively proximate to the water surface 7 and proximate to the wall surface 8.

The unitary body 6 preferably has an exterior surface contoured for efficient travel through the water. Although bodies 6 in accordance with the invention can be very differently shaped, it is intended that they be relatively compact in size fitting within a two foot cube envelope. FIG. 1A depicts a heavier-than-water body 6 which in its quiescent or rest state typically sinks to a position (shown in solid line) proximate to the bottom portion 4 of the wall 3. Alternatively, the body 6 can be lifted to a position (shown in dash line) proximate to the surface 7 of water pool 1. FIG. 1B depicts a lighter-than-water body 6 which in its quiescent or rest state rises proximate to the surface 7 of water pool 1. Similarly, the body 6 can be caused to descend to the bottom 4 portion of wall 3. As will be discussed hereinafter in connection with FIGS. 2 and 3, the body 6 carries a propulsion subsystem which is powered by electricity delivered via a flexible wire 9 from an external power source 10 or by an onboard power source, e.g., a rechargeable battery. The battery can be recharged by an onboard solar cell 11 and/or electric generator and/or by electric terminals available at a docking station 12.

In accordance with the present invention, a flexible suction hose 13 is provided to couple an external suction source to the body 6. The suction source preferably comprises the suction side 14 of a main pool pump 15 which is conventionally coupled to a main pool filter 16 for returning filtered water to the pool.

The body 6 is essentially comprised of upper and lower portions, 6U and 6L respectively, spaced in a nominally vertical direction, and front and rear portions, 6F and 6R respectively, spaced in a nominally horizontal direction. A traction means 6T, e.g. wheels, are typically mounted adjacent to the body lower portion 6L for engaging the wall surface 8.

Embodiments of the invention are based, in part, on a recognition of the following considerations:

1. Effective water surface cleaning reduces the overall task of swimming pool cleaning since most debris in the water and on the wall surface previously floated on the water surface.
2. A water surface cleaner capable of floating or otherwise traveling to the same place that the debris floats can capture debris more effectively than a fixed position built-in skimmer.
3. A water surface cleaner can collect debris as it moves across the water surface for retention in an onboard water permeable container or for passage via a hose to the main pool pump and filter.

4. A unitary cleaner body embodiment can be used to selectively operate proximate to the water surface in a water surface cleaning mode and proximate to the wall surface in a wall surface cleaning mode. An alternative body embodiment can be configured to operate exclusively adjacent either the water surface or the wall surface.
5. The level of the body 6 in the water pool 1, i.e., proximate to the water surface or proximate to the wall surface, can be controlled by a level control subsystem capable of selectively defining either a water surface mode or a wall surface mode. The mode defined by the subsystem can be selected via a user control, e.g., a manual switch or valve, or via an event sensor responsive to an event such as the expiration of a time interval.
6. The movement of the body in the water pool can be controlled by a propulsion subsystem, preferably operable in a first state to propel the body in a forward direction or a second state to propel the body in a different redirected direction. The direction is preferably commanded by an event sensor which responds to an event such as the expiration of a time interval or an interruption of the body's forward motion.
7. Enhanced system performance is attainable by providing electric power to the body for propulsion and/or cleaning in combination with water suction power for cleaning and/or propulsion and/or electric generation.

Figure 2:
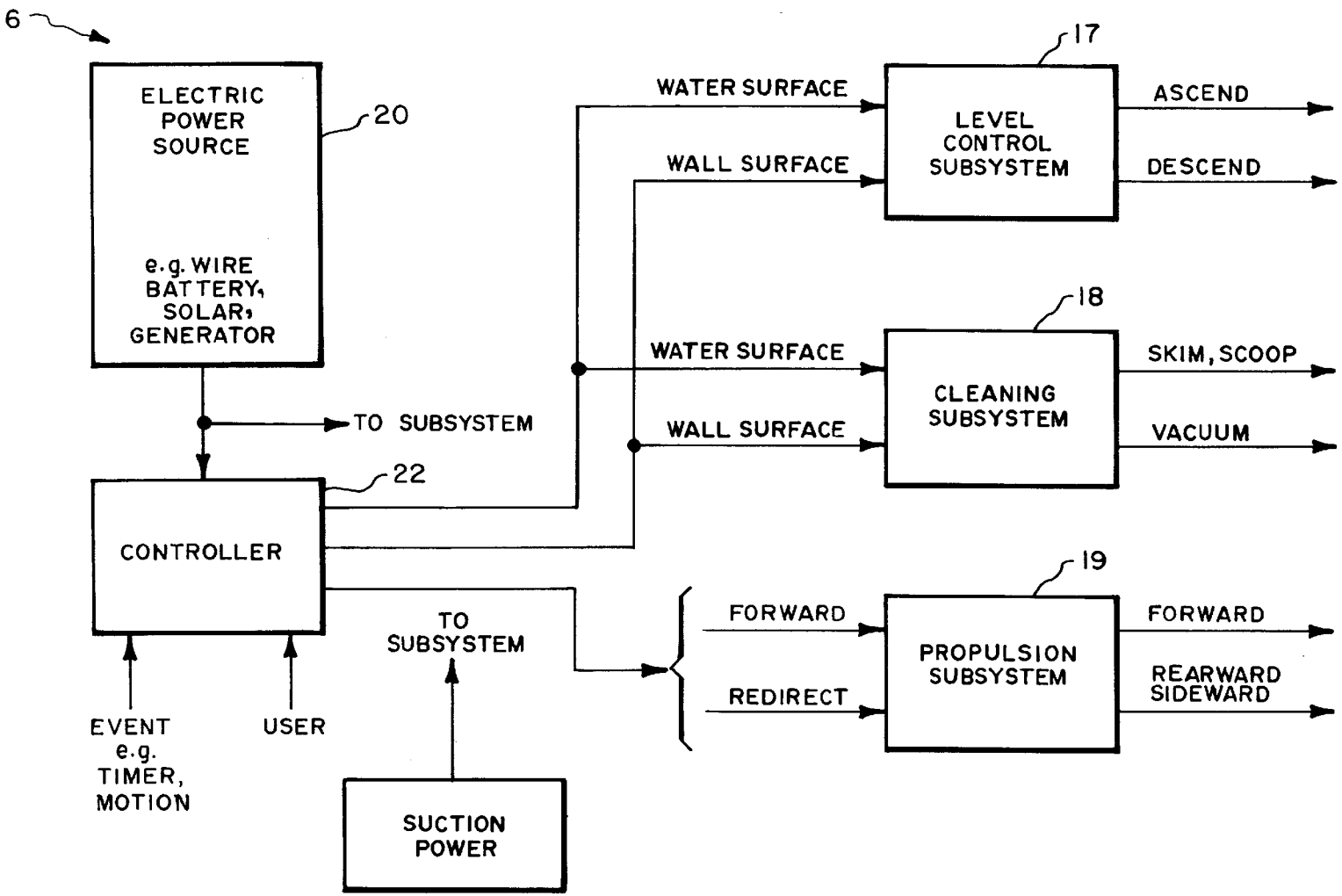
FIG. 2 is a functional block diagram generally representing the level control, cleaning, and propulsion subsystems utilized in preferred embodiments of the invention.

FIG. 2 shows a block diagram of the functional elements of a preferred body 6 in accordance with the present invention. The elements include a level control subsystem 17, a cleaning subsystem 18, and a propulsion subsystem 19. In accordance with the present invention, one or more of the respective subsystems are powered from an electric power source 20 which can, for example, comprise an external power source (as represented in FIGS. 1A, 1B) connected to the body via a flexible wire, or an onboard power source such as a solar cell and/or electric generator and/or a rechargeable battery.

The electric source 20 also powers an onboard electronic controller 22 which operates to define level modes (e.g., water surface or wall surface) and direction states (e.g., forward or redirect) in response to user and event inputs. These operating modes and states are discussed at length in applicants' aforecited US patents incorporated herein by reference. To summarize briefly, the water surface and wall surface modes are alternately defined, typically controlled by a user input or by a timed event. When the controller 22 defines the water surface mode, the level control subsystem 16 places the body proximate to the water surface and the cleaning control subsystem 18 operates to collect water therefrom, as by skimming or scooping. When the wall surface mode is defined, the level control subsystem 17 places the body proximate to the wall surface 8 and the cleaning subsystem 18 operates to collect water therefrom, as by vacuuming. In either case, in accordance with the present invention, the collected water can be directed through the suction hose 13 for passage to the main pool pump and filter. Additionally, the collected water can be passed through an onboard porous debris collection container which must be periodically emptied by the user.

The controller 22 primarily defines the forward state which causes the propulsion subsystem 20 to move the body 6 in a forward direction along either the water surface or wall surface to effect cleaning. However, in order to avoid lengthy cleaning interruptions, as could be caused by the body 6 getting trapped behind an obstruction in the pool, the controller preferably periodically defines the redirect state. Switching to the redirect state can be initiated by a timed event or, for example, by a sensed interruption of the body's forward motion. In the redirect state, a force is produced to rotate the body and/or translate the body, e.g., rearwardly and/or sidewardly.

Figure 3:
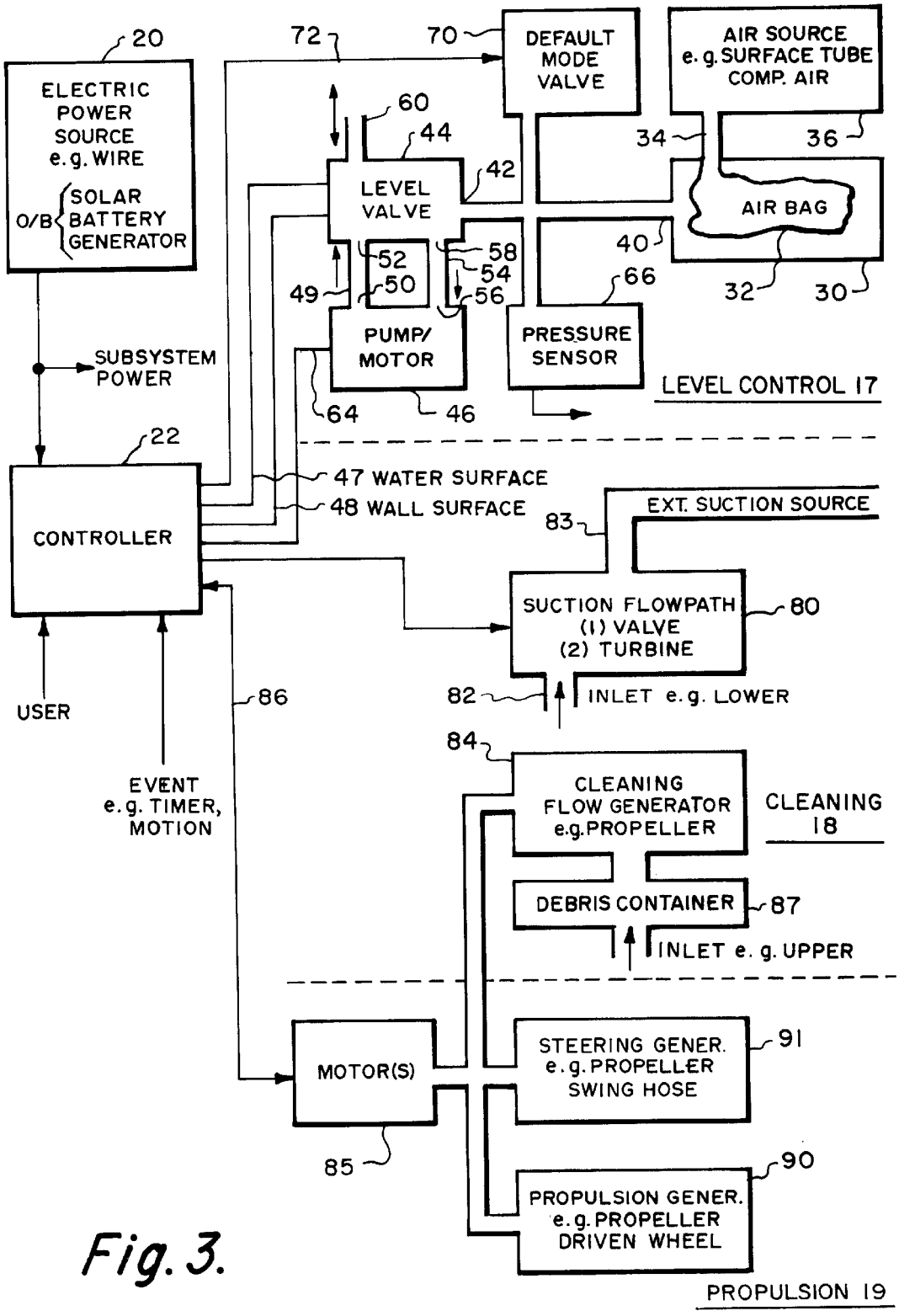
FIG. 3 is a more detailed functional block diagram of a preferred embodiment of the invention.

Attention is now directed to FIG. 3 which is a block diagram depicting a preferred arrangement of the functional control system shown in FIG. 2 in greater detail. The level control subsystem 17 is implemented to modify the effective buoyancy of the body. In a preferred embodiment, a closed fluid chamber 30 containing an air bag 32 is used to modify body buoyancy. The port 34 to the air bag 32 is coupled to an air source 36 which can, for example, comprise an onboard reservoir storing compressed air or a tube extending from the body 6 to a point above the pool surface 7.

A port 40 selectively either supplies fluid, typically water, under pressure to the chamber 30 or allows fluid to flow out of the chamber, depending upon the pressure at port 42 of level valve 44. The level valve 44 is coupled to pump/motor 46 and is controlled by controller outputs 47, 48. More specifically, tube 49 couples the pressure port 50 of pump/motor 46 to inlet port 52 of level valve 44. Tube 54 couples the suction port 56 of pump/motor 46 to outlet port 58 of level valve 44. Level valve 44 is also provided with a port 60 which is open to pool water.

A heavier-than-water body 6 can be floated to the surface by extracting water from chamber 30 and allowing the volume of air in bag 32 to expand. In order to extract water from chamber 30, the level valve 44 is operated in the water surface mode commanded by output 47 to couple port 42 to pump/motor suction port 56. In this state, the level valve directs the positive pressure output from the pump/motor supplied to port 52 out through open port 60.

In the wall surface mode commanded by output 48, water is supplied under pressure to chamber port 40 to force air out of the bag 32, either back into the aforementioned compressed air reservoir or out through the surface tube. To supply water under pressure to chamber port 40, level valve 44 is operated to couple the pressure port 50 of pump/motor 46 to level valve port 42. In this state, port 60 operates as a water source enabling water to be pulled through the level valve and tube 54 into the suction port 56 of the pump/motor 46. The two states of the level valve 44 are controlled by controller outputs 47, 48. The energization of the pump/motor 46 is controlled by controller output 64.

It is preferable that the level control subsystem 17 also include a pressure sensor 66 for sensing the pressure level in the tube between level valve port 42 and chamber port 40. The output of the pressure sensor 66 comprises one of the event inputs to controller 22 to cause it to de-energize pump/motor 46 when the pressure is out of limits. The implementation of the level control subsystem 17 preferably also includes a default mode valve 70. In normal operation, this valve is closed as a consequence of a signal provided by controller output terminal 72. However, when electric power is removed, attributable to normal shut down or power depletion, the valve 70 defaults to an open position which can, for example, enable the compressed air source to supply air to the bag 32 to allow the body 6 to ascend, even in the absence of electrical power. If a surface tube is used, air can escape via the tube to cause the body 6 to sink.

Figure 15:
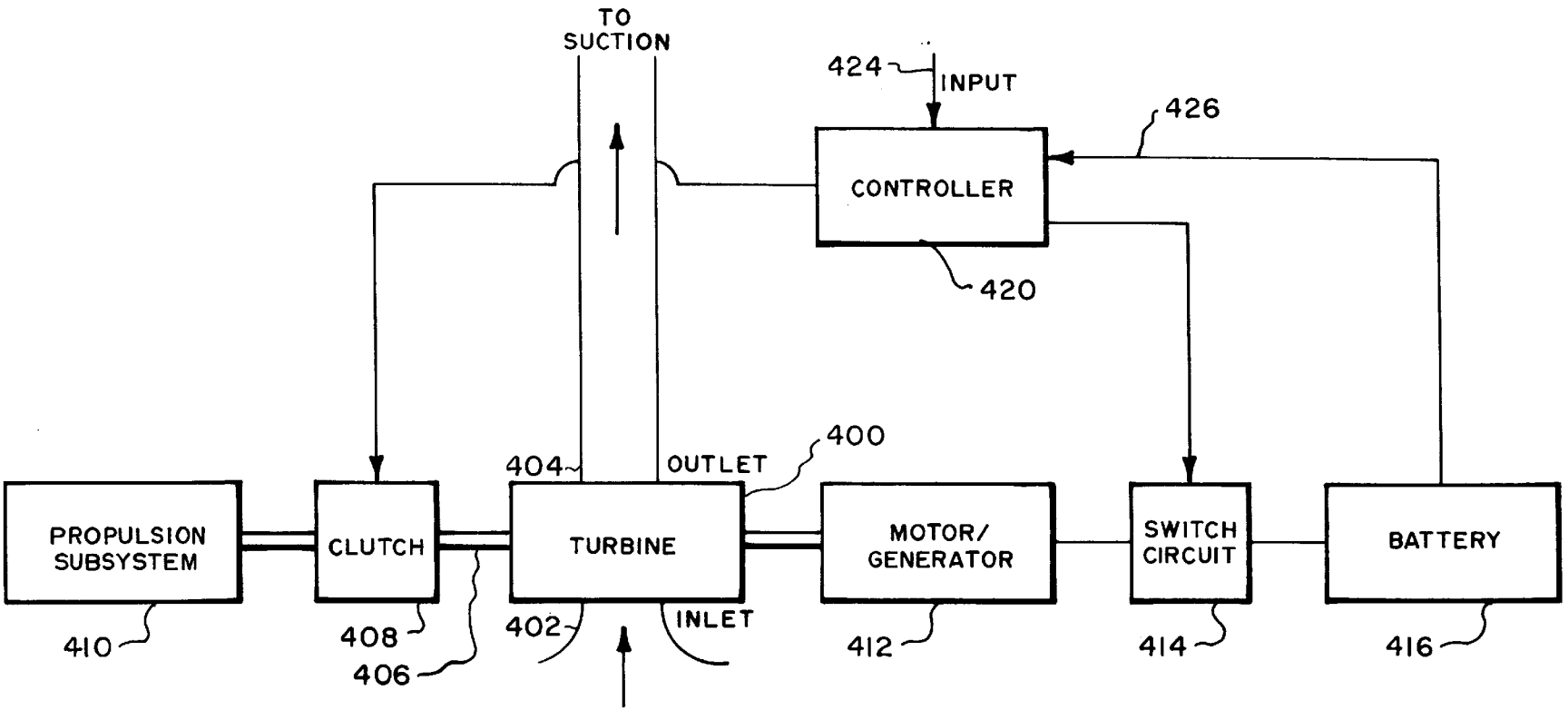
FIG. 15 is a block diagram depicting how a turbine can be used to (1) drive a propulsion subsystem, assisted by a motor, and (2) generate electricity to charge an onboard battery.

The cleaning subsystem 18 is preferably implemented by a suction flow path 80 formed in the cleaner body between one or more inlets 82 and an outlet 83 coupled via a suction hose 13 to a suction source 15 (FIGS. 1A, 1B). As will be discussed hereinafter, the inlets preferably include a lower inlet located on the body 6 so as to be proximate to the wall surface when operating in the wall surface mode and an upper inlet located on the body 6 so as to be proximate to the water surface when operating in the water surface mode. The flow path 80 optionally includes a valve controlled by controller 22 for optimally allocating the available suction to the respective inlets. The flow path 80 can optionally also, or alternatively, include a turbine capable of driving an onboard electric generator. The turbine can also, or alternatively, be used to mechanically drive, or augment the drive to, the propulsion generator to be discussed hereinafter (FIG. 15). The cleaning subsystem 18 can also include a supplemental cleaning flow generator 84, e.g., a propeller, for pulling pool water into the body. In the preferred embodiments to be discussed hereinafter, the cleaning flow generator 84 primarily functions to draw in surface water, via the upper inlet, which is passed through an onboard porous debris collection container 87. The cleaning flow generator 84 is driven by the output shaft of motor 85 via appropriate gearing, not shown.

The propulsion subsystem 19 can be implemented by a propulsion generator 90 which can comprise a propeller, a driven traction member, and/or a discharged water jet. The propulsion generator 90 is driven by the output shaft of motor 85. The energization and direction of the motor is controlled by controller output 86. Rotation of the shaft in a first direction produces a forward thrust on the body. Rotation of the shaft in an opposite direction produces a rearward and/or sideward thrust to redirect the body. As previously mentioned, rotation of the output shaft of motor 85 can be augmented by power derived from the aforementioned turbine in flow path 80. The propulsion subsystem 90 also includes a steering generator 91 which can continually or periodically vary the propelled direction of the body. The steering generator can be implemented with an off-axis propeller or by varying the direction of drag imposed by the hose on the body 6.

As will be discussed hereinafter, the cleaning subsystem 18 and propulsion subsystem 19 can share a common propeller. When the motor 85 shaft rotates in a first direction, it drives the propeller to propel the body forwardly and additionally draws pool water in for cleaning. When the shaft rotates in an opposite direction, the propeller can discharge a rearward and/or sideward flow to redirect the body.

Figure 4:
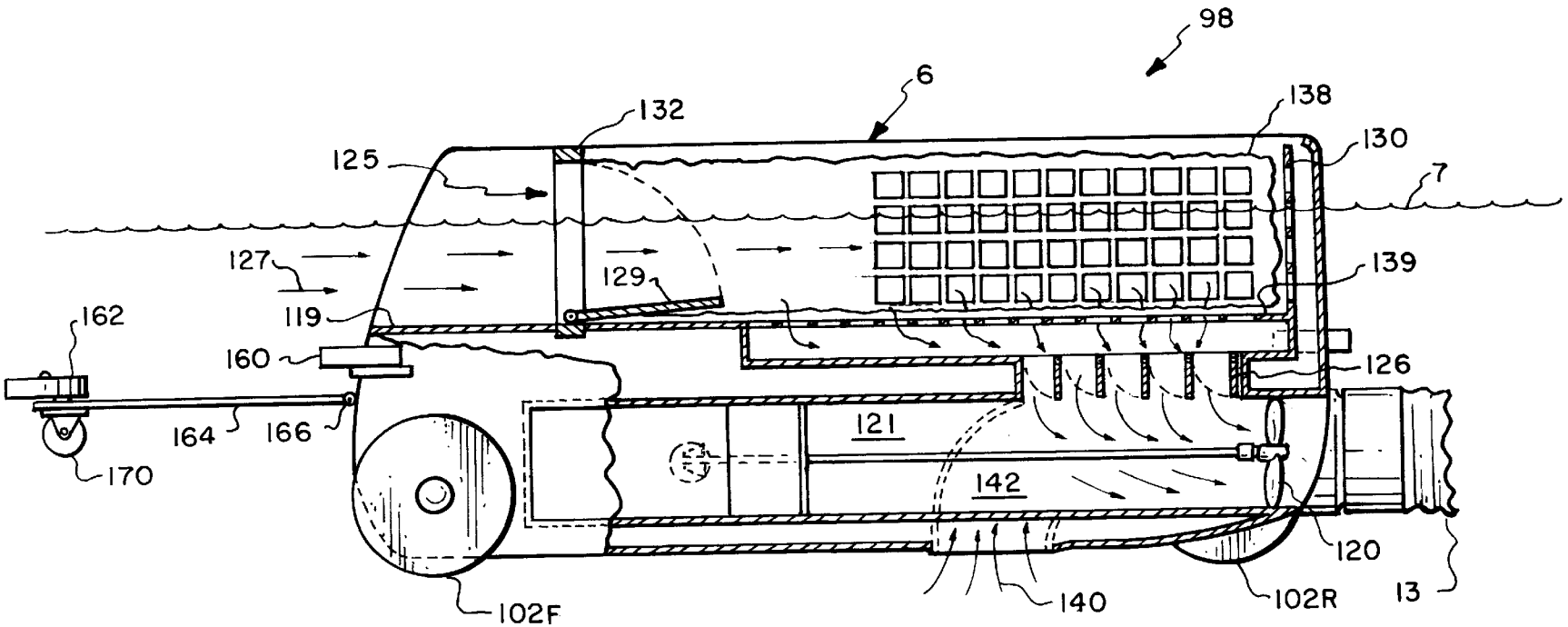
FIG. 4 comprises a side view of a first structural embodiment of the invention partially cutaway to show internal body detail, operating at the water surface.
Figure 5:
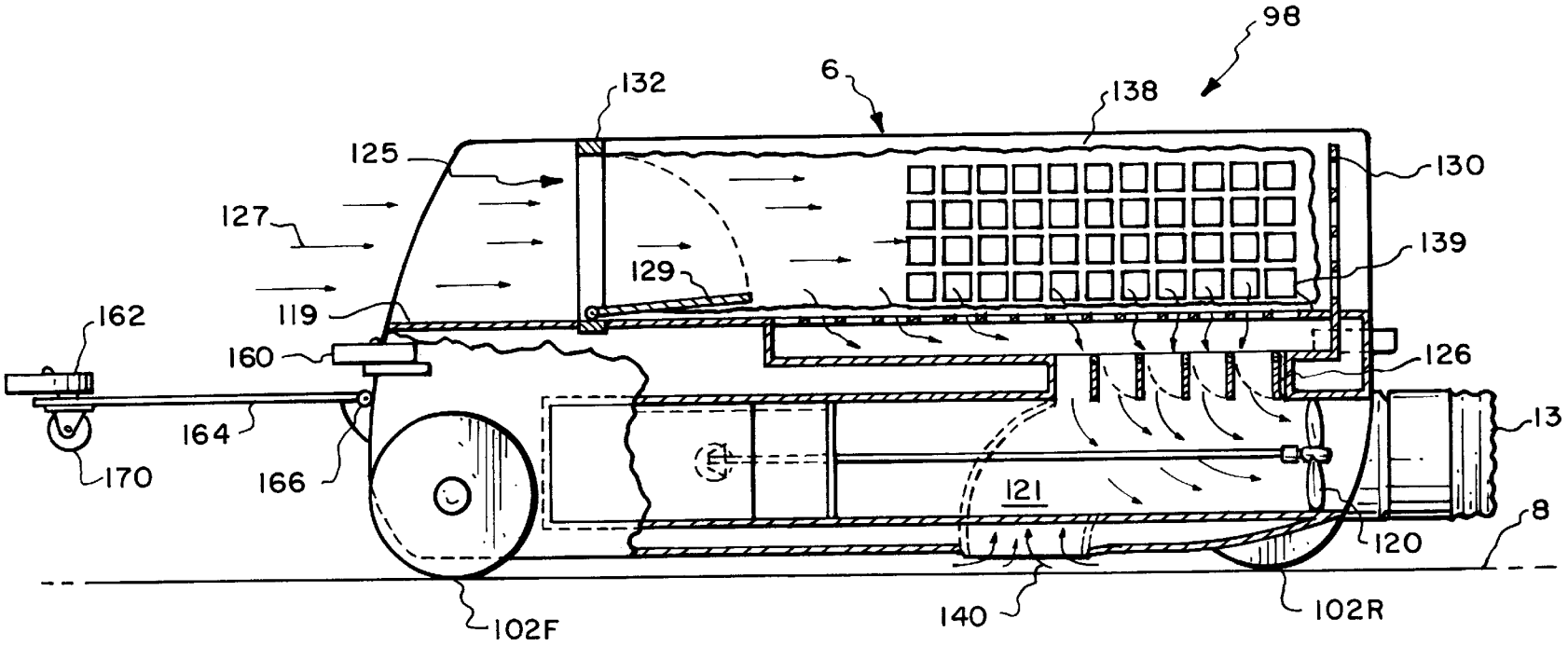
FIG. 5 comprises a side view of the embodiment of FIG. 4 operating at the wall surface.
Figure 6:
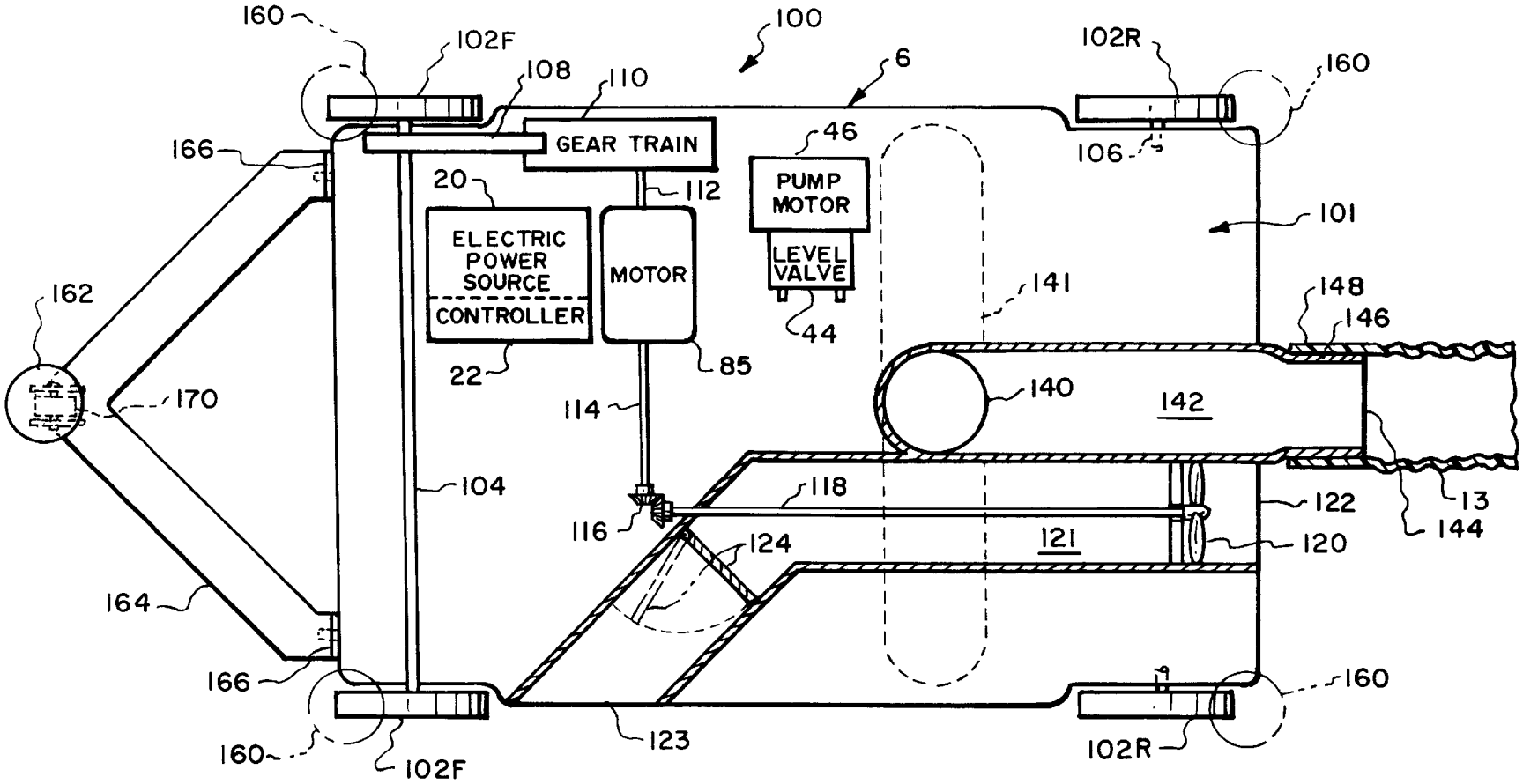
FIG. 6 comprises a top view of the embodiment of FIGS. 4 and 5.

Attention is now directed to FIGS. 4, 5, and 6 which illustrate a first preferred embodiment 98 which operates consistently with the aforediscussed block diagram of FIG. 3. FIGS. 4 and 5 respectively depict operation of the body 6 at the water surface 7 and at the wall surface 8. The body 6 essentially comprises a rectangular housing 100 defining an interior volume 101 (FIG. 6) and supported on multiple traction wheels 102. Front wheels 102F are mounted on a common drive axle 104. Rear wheels 102R are mounted on spindles 106. Drive axle 104 is coupled by a gear 108 and gear train 110 to output shaft 112 of aforementioned drive motor 85. Drive motor 85 is additionally coupled by a shaft 114 and bevel gear 116 to propeller drive shaft 118.

When the body 6 is to be propelled in a forward direction, motor 85 rotates in a first direction to drive wheels 102F via axle 104 and propeller 120 via shaft 118. Rotation of the propeller 120 in a first direction operates to draw water through propeller tunnel 121 for discharge rearwardly through port 122. In this forward propulsion state, tunnel 121 is closed to port 123 by check valve 124 and open to upper inlet 125 via open shutter elements 126.

To operate in the backup or redirect propulsion state, motor 85 rotates in a second direction to oppositely drive the wheels 102F and propeller 120. This action causes propeller 120 to pull water into port 122, closing shutter elements 126, for discharge past check valve 124 through port 123 in a forward/sideward direction to produce a rearward/sideward force on the body.

In addition to motor 85, the body interior volume 101 accommodates the aforementioned pump/motor 46 and level valve 44. The motor 85 and pump/motor 46 are electrically driven from power source 20 which, as previously noted, can constitute an onboard solar cell, battery or electric generator, or a flexible wire extending from the body 6 to an external power source as depicted 1A, 1B. The body 6 also houses the aforementioned controller 22 as shown in FIGS. 6.

The body 6 is configured to move through the pool proximate either to the pool water surface 7 or wall surface 8. When at the water surface, forward propulsion is achieved by the outflow through opening 122 produced by propeller 120. When at the wall surface, forward propulsion is primarily achieved by the driven front wheels 102F, supplemented by the outflow through 122.

The body 6 is configured so that when operating at the water surface, pool water flows over deck 119 into inlet 125, as represented by the flow arrows 127. This flow into inlet 125 swings open gate 129 to the position shown in solid line in FIG. 4. The surface water 127 will flow via inlet 125 into basket 130 through the open basket mouth 132 defining the inlet 125. Gate 129 is sufficiently buoyant to rise and prevent outflow of debris from the basket 130, e.g., when the body moves rearwardly. The basket 130 preferably contains a removable porous debris collection container or bag 138. The water 127 flowing over the deck 119 into the collection bag 138 deposits its debris in the bag and then passes out through the basket floor 139 past the shutter elements 126 into the propeller tunnel 121. The propeller 120 operates to pull water from tunnel 121 and discharge it rearwardly through port 122 to produce a forward propulsion force.

In addition to the upper inlet 125, body 6 also defines a lower inlet 140 which is located on the body so as to be proximate to the wall surface 8 when operating in the wall surface mode (FIG. 5). Inlet 140 preferably resides in recess 141 which extends across a major portion of the width of body 6. A flow path 142 couples inlet 140 to a water outlet 144 defined by a hose fitting 146. The hose fitting 146 mounts the distal end 148 of the flexible suction hose 13. The aforementioned suction source 15 coupled to the proximal end of the suction hose 13, acts to pull water and debris into the inlet 140 from adjacent the wall surface 8 for passage through flow path 142, outlet 144, and hose 13 to the filter 16 (FIG. 1A).

When the redirect propulsion state occurs during wall surface operation, the rotation of motor 85 is reversed to drive wheels 102F and propeller 120 in the opposite direction. Thus, the propeller draws water via port 122 into tunnel 121. This action causes shutter elements 126 to close and check valve 124 to open. Thus, the flow drawn into port 122 is discharged through port 123 to produce a rearward and sideward force on body 6.

It should also be noted in FIG. 6 that horizontally oriented guide wheels 160 are mounted around and project from the periphery of the body housing 100. The guide wheels are provided to facilitate movement of the body primarily around vertical surfaces, e.g., step risers, in the pool. Additionally. A forwardly projecting guide wheel 162 is mounted on bracket 164 hinged at 166 to the body housing for upward movement. The guide wheel 162 primarily functions in the water surface mode to engage the pool wall surface and facilitate movement of the body around obstructions. A castor wheel 170 is preferably mounted beneath guide wheel 162 for engaging and riding over contoured surfaces when the unit operates in the wall surface mode.

Figure 7:
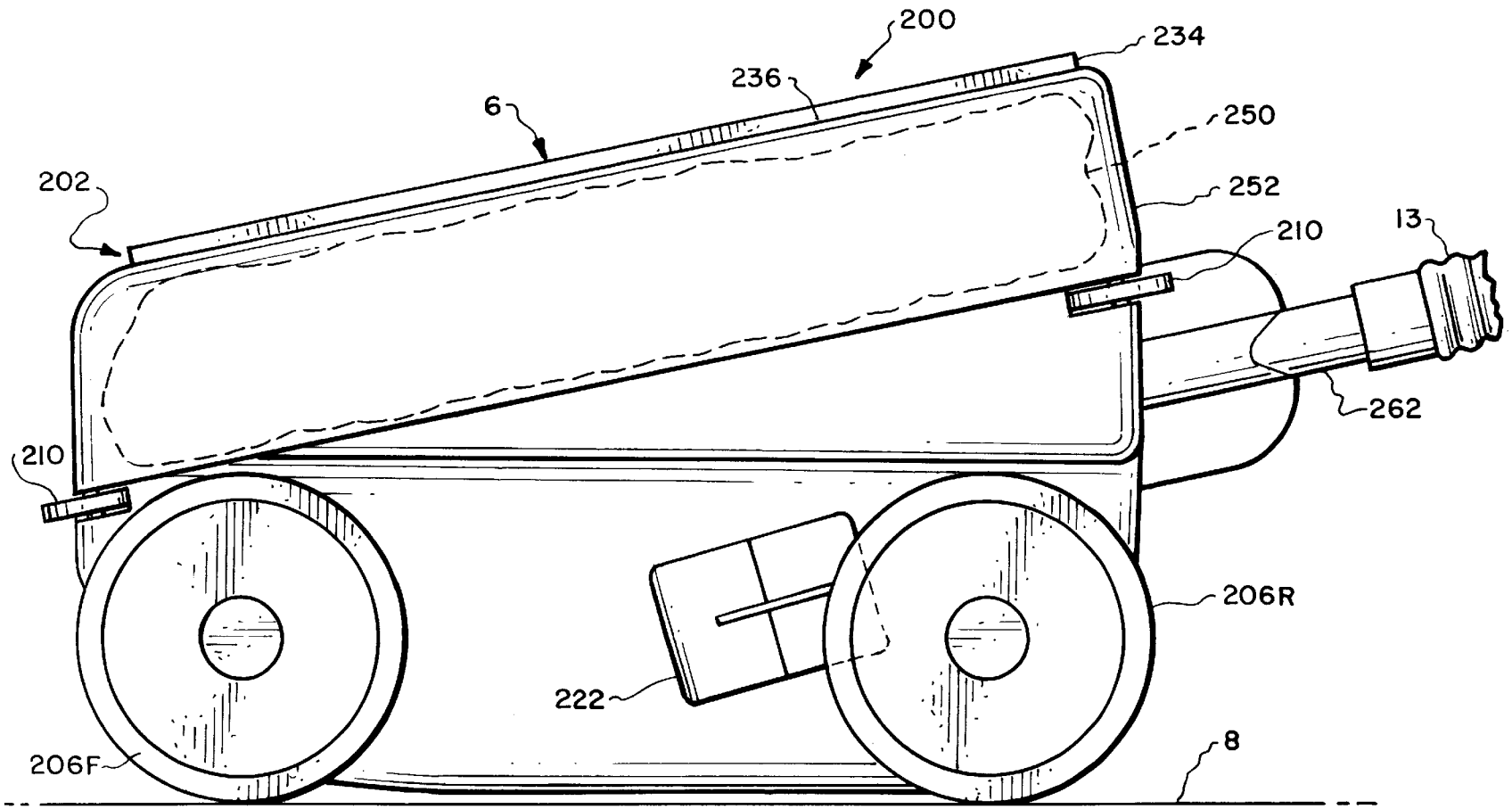
FIG. 7 is a side view of a second structural embodiment of the invention.
Figure 8:
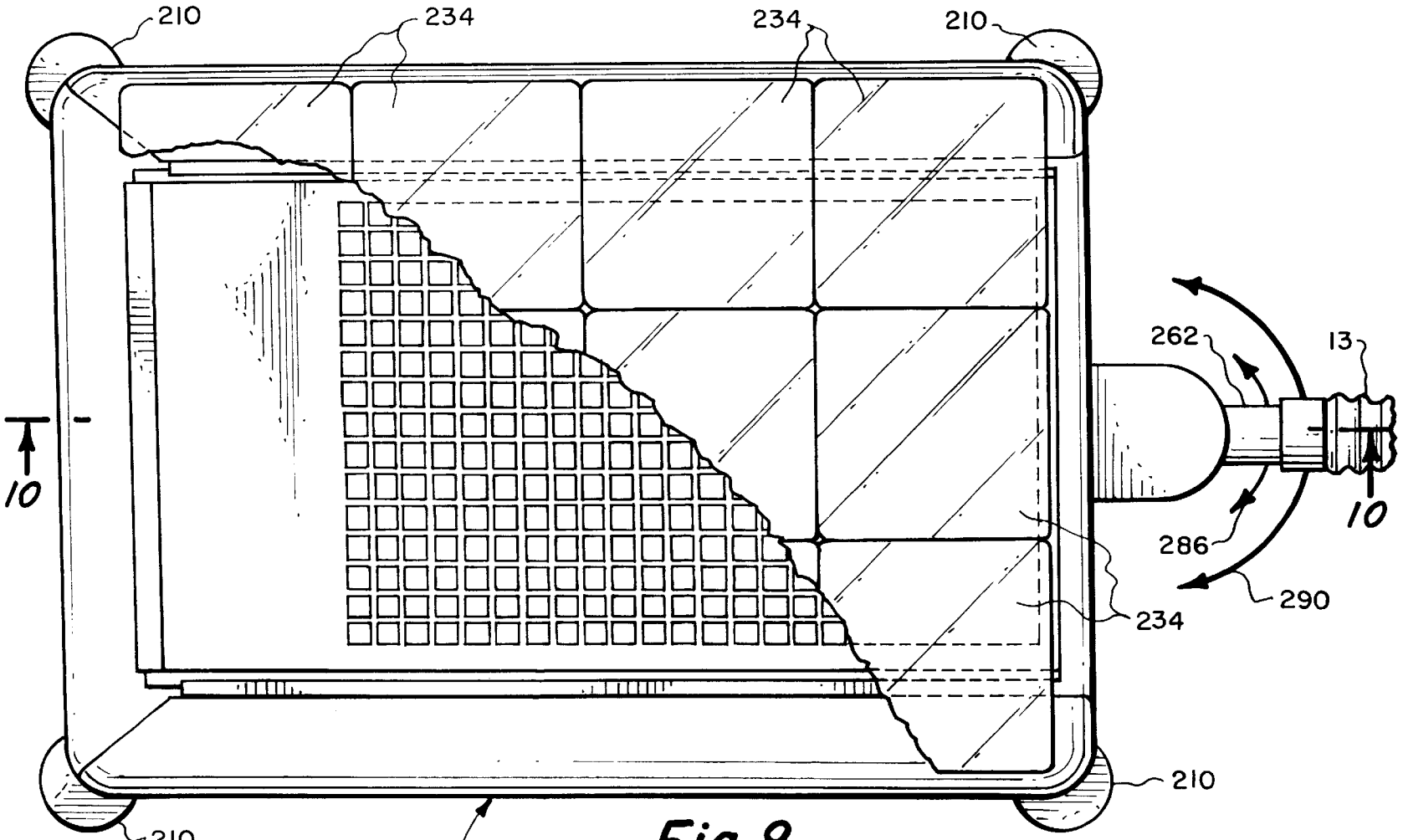
FIG. 8 is a top view of the embodiment of FIG. 7.
Figure 9:
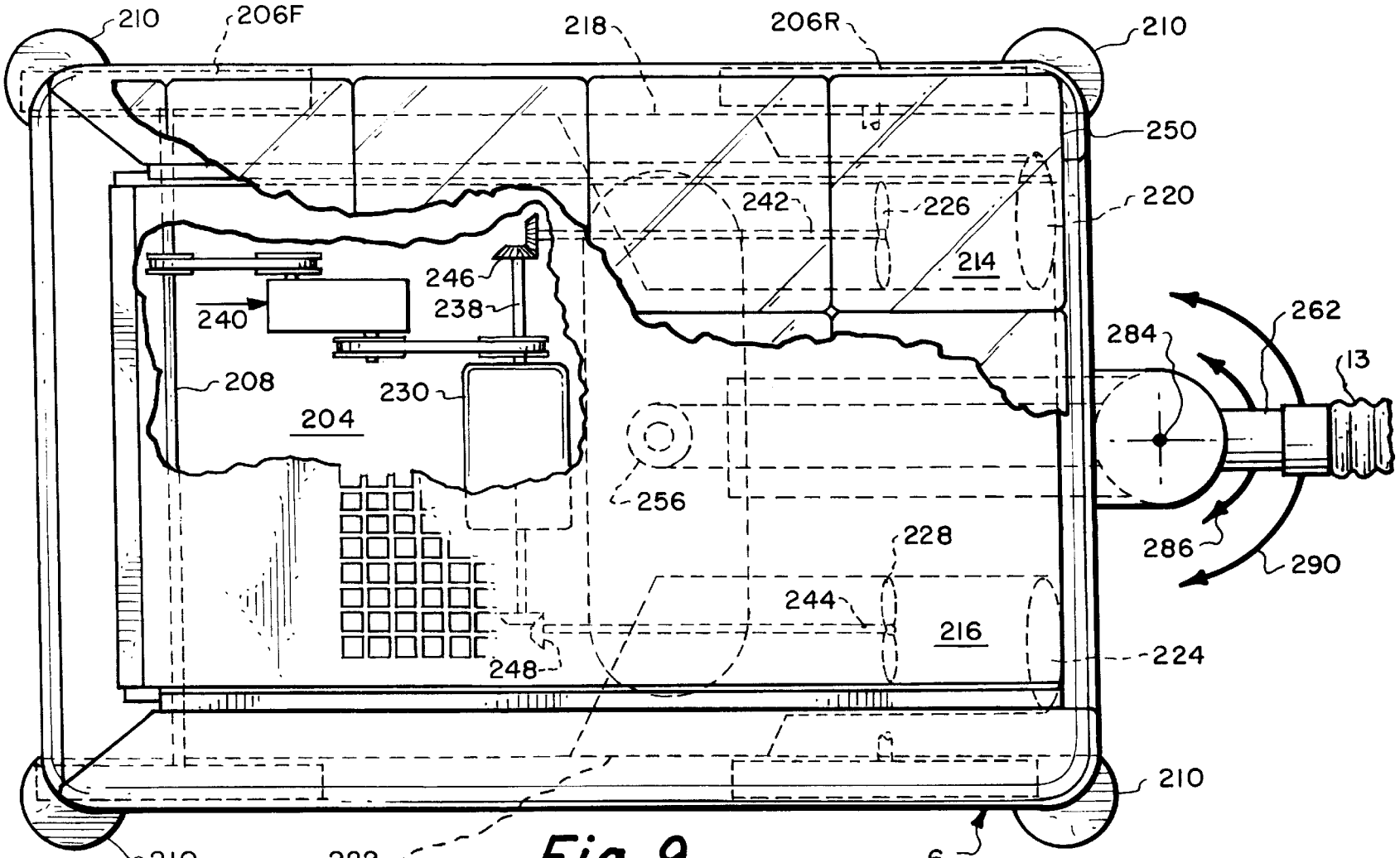
FIG. 9 is a top view similar to FIG. 8 partially broken away to show interior detail.
Figure 10:
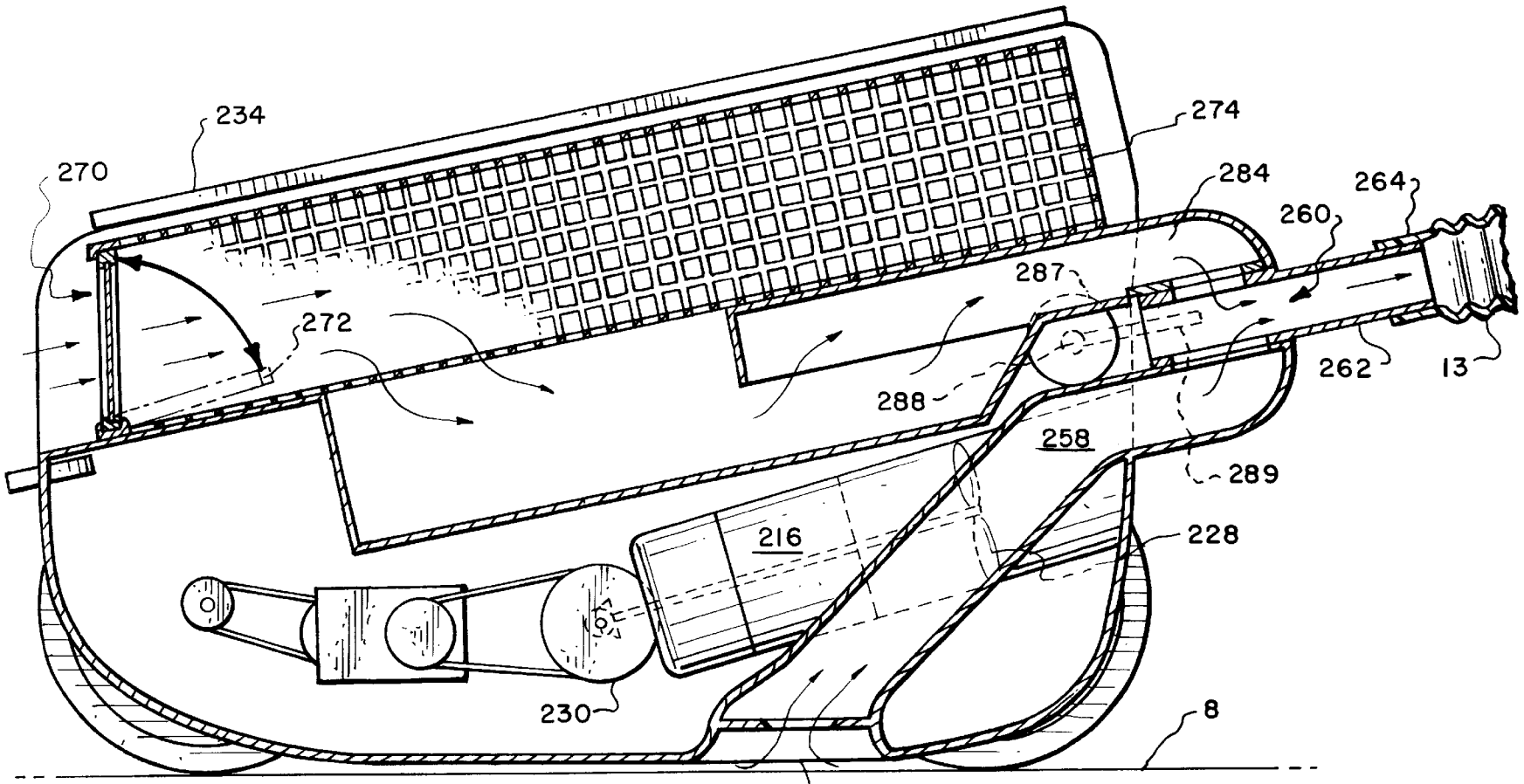
FIG. 10 is a sectional view taken substantially along the plane 10—10 of FIG. 8.
Figure 11:
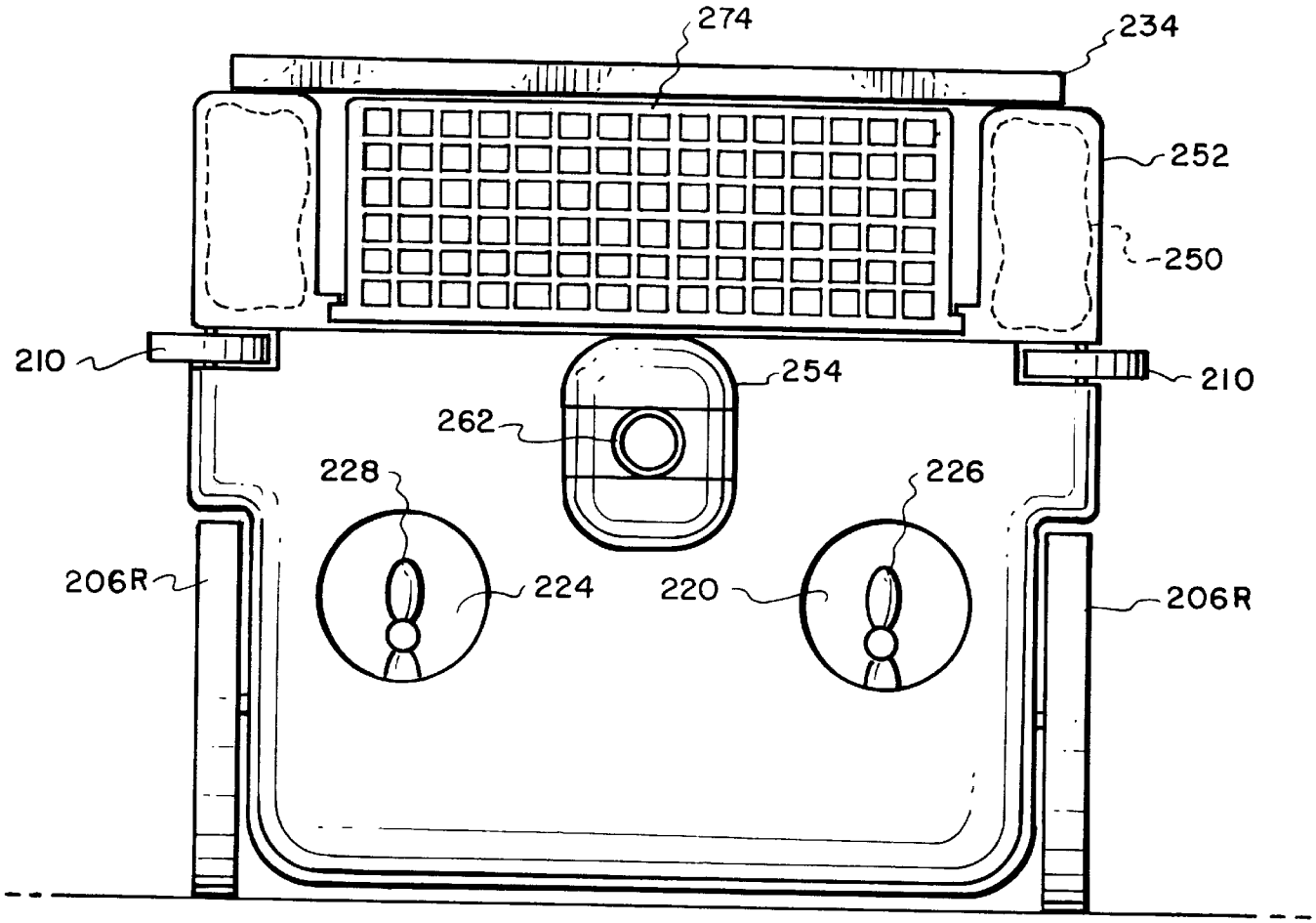
FIG. 11 is a rear view of the embodiment depicted in FIGS. 7–10.

Attention is now directed to FIGS. 7–11 which depict a second embodiment 200 of the invention which operates consistently with the functional block diagram of FIG. 3. The embodiment 200 includes a body 6 comprised of a substantially rectangular housing 202 defining an interior volume 204 (FIG. 9). The housing 202 is supported on traction means such as wheels 206 for engaging the pool wall surface 8 (FIG. 7). The front wheels 206F are mounted on a common axle 208. The rear wheels 206R can be mounted on independent spindles. Horizontally oriented guide wheels 210 project from the periphery of the housing 202 for engaging vertical surfaces to facilitate movement of the housing 202 through the pool. The housing defines first and second propeller tunnels 214 and 216. Tunnel 214 extends from port 218 to port 220. Tunnel 216 extends from port 222 to port 224. Propellers 226 and 228 are respectively mounted for rotation in propeller tunnels 214 and 216.

A propulsion drive motor 230 is mounted within the housing interior volume 204. The motor 230 is powered electrically, for example, by an onboard electric power source such as solar cell and/or electric generator and/or battery, or from an external electric power source via an electric wire. FIGS. 7–11 depict an exemplary solar cell 234 mounted on the upper exterior surface 236 of housing 202. The output shaft 238 of motor 230 is configured to drive the front wheel axle 208 via a belt/gear transmission 240. Additionally, the motor shaft 238 is configured to drive propeller shafts 242 and 244, respectively carrying propellers 226 and 228, via bevel gear mechanisms 246 and 248.

When operating in the wall surface mode with the wheels 206 engaged against wall surface 8, forward propulsion is achieved primarily as a consequence of front wheels 206F being driven. When operating in the water surface mode, forward propulsion is primarily achieved by the thrust produced by propellers 226 and 228. More specifically, the propellers 226 and 228 function to pull water into tunnels 214 and 216 from side ports 218 and 222, for discharge through rear ports 220 and 224.

The embodiment of FIGS. 7–11 preferably includes a level control system comprised of airbags 250 mounted in upper side chambers 252. As has been previously described, the airbags 250 can be selectively expanded and compressed to modify the buoyancy of the body 6 to carry it either to the water surface 7 or the wall surface 8. As mentioned in connection with FIG. 3, an air source for the bags 250 can comprise either an onboard compressed air reservoir or an air tube extending to the surface. The level valve depicted in FIG. 3 is used to selectively fill and exhaust, or expand and compress, the airbag 250 for level control.

Housing 202 defines a lower inlet 256 extending through a flow path 258 to a rear outlet 260 defined by a substantially rigid tubular hose fitting 262. The hose fitting 262 is adapted to mount the distal end 264 of the suction hose 13 whose proximal end is coupled to suction source 15 as depicted in FIGS. 1A and 1B. Suction supplied by the pump 15 via the hose 13 to the fitting 262 functions to pull water and water borne debris through lower inlet 256 and flow path 258 to outlet 260 for passage through the hose 13 to the filter 16 (FIG. 1A).

The housing 202 additionally defines an upper inlet 270 which is located to pull in surface water past a gate 272 when operating in the water surface mode. Water pulled in past gate 272 enters a removable porous debris collection basket 274. The embodiment of FIGS. 7–11 differs from the embodiment of FIGS. 4–6 primarily in that steering is achieved by pivoting the hose fitting 262 about a substantially vertical axis 284 through a minor arc 286. The hose fitting 262 can be pivoted by the motor 230, or alternatively, by a separate electrically driven reversible motor, e.g. motor 287 driving lead screw 288 engaged with arcuate rack 289 affixed to hose fitting 262. By pivoting the hose fitting 262 through the minor arc 286 about the substantially vertical axis 284, the hose drag on the body 202 will continually (or periodically) vary to cause the body to traverse a substantially random path along the wall surface 8 and the water surface 7. In order to define the backup or redirect propulsion state to extricate the body from obstructions, the steering means can be commanded to pivot the hose fitting 262 through a major arc 290 represented in FIG. 9.

Figure 12:
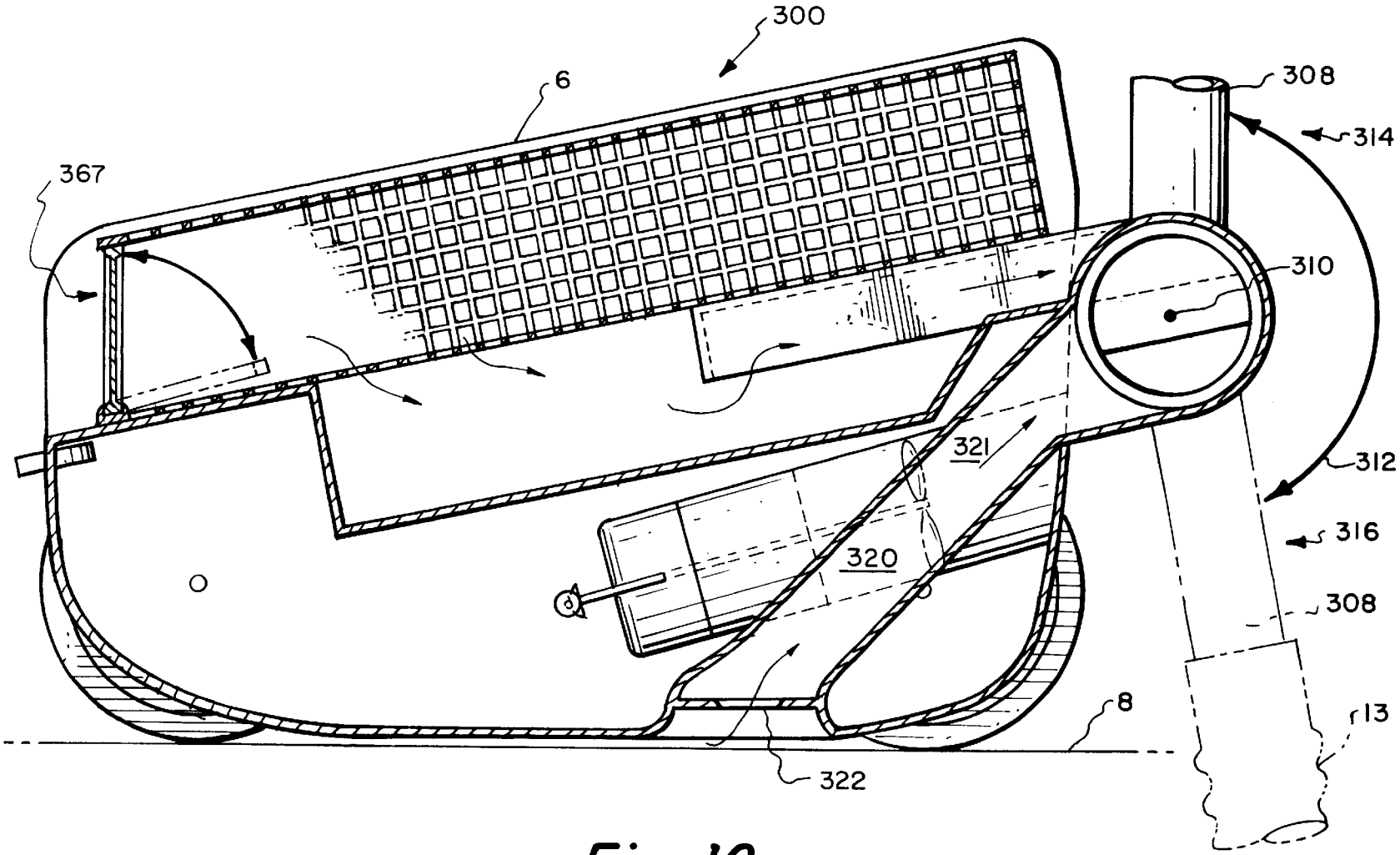
FIG. 12 is a sectional view similar to FIG. 10 depicting a third embodiment.
Figure 13:
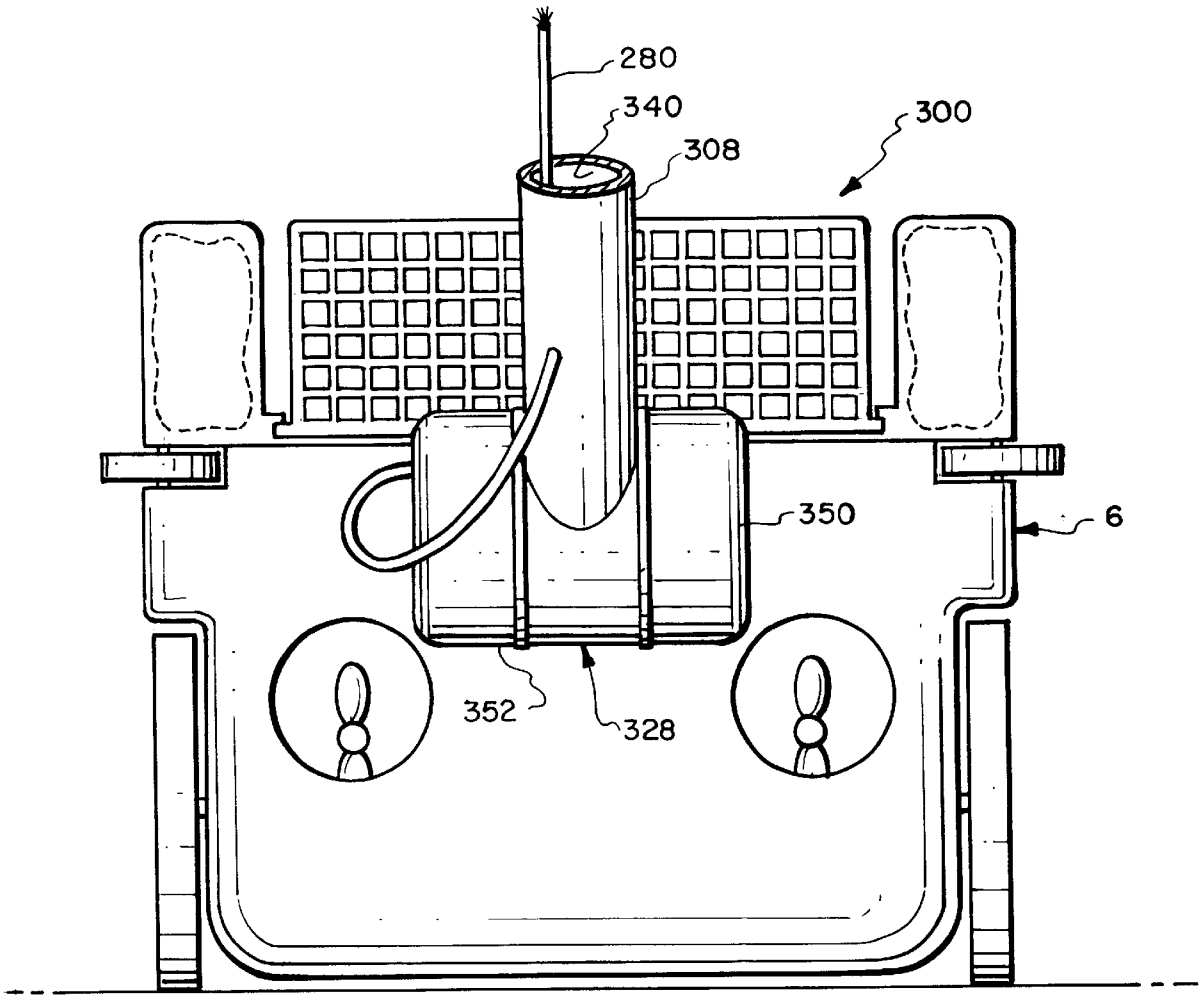
FIG. 13 is a rear view of the embodiment of FIG. 12.
Figure 14:
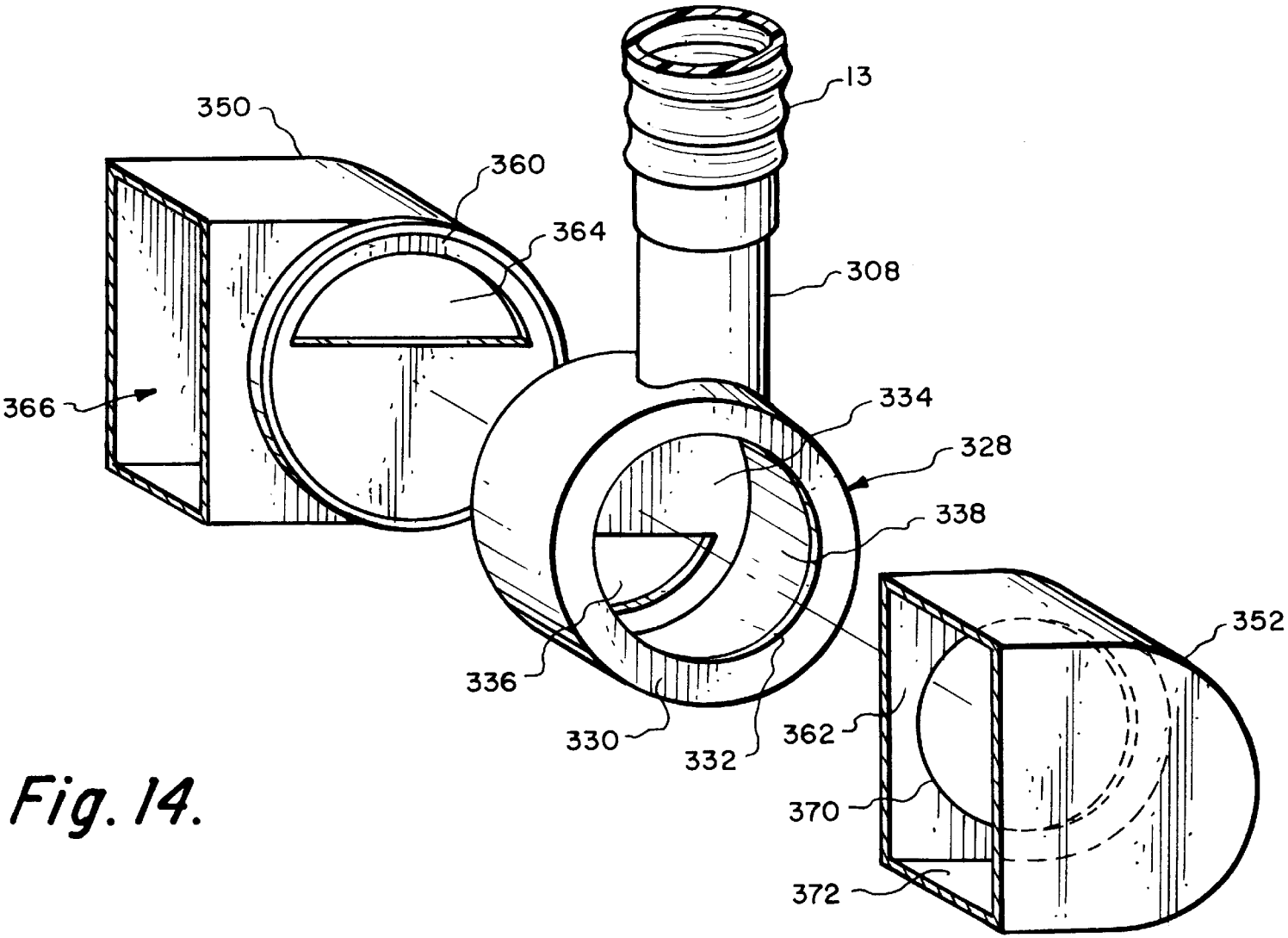
FIG. 14 is a isometric view of a valve mechanism employed in the embodiment of FIGS. 12 and 13 to provide increased wall surface cleaning water flow when the body operates in the wall surface cleaning mode.

Attention is now directed to FIGS. 12–14 which illustrate a third embodiment 300 of the invention. The embodiment 300 is identical in most respects to the embodiment 200 of FIGS. 7–11. However, whereas the rigid hose fitting 262 in the embodiment 200 is mounted to be swivelled about a substantially vertical axis 284 to effect steering, the hose fitting 308 of embodiment 300 is mounted for swivel movement about a substantially horizontal axis 310. More particularly, hose fitting 308 is mounted for movement around axis 310, as represented by arc 312 (FIG. 12), between an up-position 314 shown in solid line and a down-position 316 shown in dashed line. The position of the hose fitting 308 is controlled by the level valve 44 (FIG. 3), e.g., via the pump/motor 46. That is, when the level valve defines the wall surface mode, the hose fitting 308 is moved to the up-position 314 and when the level valve defines the water surface mode, the hose fitting 308 is moved to the down-position 316.

By pivoting the hose fitting 308, the distal end of the hose 13 is oriented optimally for unobstructed movement of the body. That is, when the body is operating in the wall surface mode, moving the hose fitting 308 to the up-position moves the hose out of the travel path of the body thus assuring that the body will not be obstructed by the hose. Similarly, when the body is operating in the water surface mode, the down-position 316 of the hose fitting 308 assures that the hose 13 will not obstruct travel of the body 6 along the water surface.

Attention is now directed particularly to FIG. 14 which shows a preferred implementation of the mounting of hose fitting 308. Note that the hose fitting 308 comprises a tube projecting radially from a tubular cylindrical member 328. A first end face 330 of the member 328 defines a large opening 332. A second end face 334 of member 328 is closed except for a sector opening 336. The end faces 330 and 334 and cylindrical member 328 enclose a cavity 338 which communicates with the interior passageway 340 through hose fitting 308.

The cylindrical member 328 is nested between casings 350, 352 for limited rotation about the substantially horizontal axis 310. Casing 350 defines end plate 360 which is solid except for a sector opening 364 defined therein. The opening leads to passageway 366 which extends to the aforediscussed upper inlet 367, corresponding to inlet 270 in FIG. 10. Note that end plate 360 opposes face 334 of cylindrical member 328.

Casing 352 defines end plate 362 which includes a full opening 370. Note that opening 370 is aligned with opening 332 in end face 330 of cylindrical member 328.

When the hose fitting 308 is in its up-position 314, the suction supplied by hose 13 is communicated by fitting 308 to the cavity 338. In this up-position, note that sector openings 336 and 364 are misaligned. Thus, the suction available from hose 13 is not coupled to passageway 366 and the upper inlet 321 but rather is fully allocated to opening 370 which extends via passageway 372 to the lower inlet 322 (FIG. 12). On the other hand, when the body is operated in the water surface mode, meaning that the hose fitting 308 is swivelled to the down-position 316, then the suction supplied by hose 13 is allocated to both passageway 366 and passageway 372 to pull water into both the upper and lower inlets. Although an exemplary valve configuration has been described, it should of course be understood that any particular valve should be configured to optimize the suction respectively allocated to the upper and lower inlets 321, 322 depending upon the geometry and dimensions of the various flow paths.

The embodiment 200 of FIGS. 7–11 depicts a solar cell 234 mounted on the body 6. However, reference has been made to the fact that electric power can be supplied by a variety of alternative onboard means as well as by an electric wire extending to an external source 10, as in FIG. 1A. FIG. 13, as an example, depicts a preferred manner of running an electric wire 380 through the hose 13 and fitting 308 to the body 6. Parenthetically, a surface air tube, mentioned at 36 in FIG. 3, can also extend through the fitting 308 and hose 13, as is represented for the electric wire 380 in FIG. 13.

Attention is now directed to FIG. 15 which schematically shows an arrangement in which a turbine 400 mounted in the suction flow path can be advantageously used to generate electricity and/or provide enhanced driving power for propulsion.

More particularly, consider that turbine 400 is mounted in the flow path between body water inlet 402 and outlet 404. Outlet 404 is coupled via a suction hose to a suction source, e.g., pump 15 of FIG. 1A. The turbine 400 shaft 406, via clutch 408, drives propulsion subsystem 410, e.g., driven traction means, propeller, etc. Additionally, turbine shaft 406 is coupled to motor/generator 412. Switching circuit 414 couples motor/generator 412 to onboard battery 416.

Controller 420 electrically controls both clutch 408 (i.e., engaged or disengaged) and switching circuit 414 (i.e., motor mode or generator mode). As previously discussed, controller 420 can respond to external inputs 424 supplied for example by the user, via a timer, via a motion sensor, etc. FIG. 15 additionally shows an input 426 from the battery 416 used to indicate a "low battery" state.

In normal cleaning operation, with the battery 416 sufficiently charged, clutch 408 will be engaged and switching circuit 414 will define the motor mode. Accordingly, drive power is cooperatively delivered by both the turbine 400 and motor 412 for driving the propulsion subsystem 410. Assume now that the controller 420 senses a low battery state, then it will disengage clutch 408 and switch circuit 414 to the generator mode enabling the generator 412 driven by turbine 400 to charge the battery 416.

It is intended that in the normal operation of an embodiment in accordance with FIG. 15 that the system operate in a pool cleaning mode for a certain duration, e.g., four hours. After completion of the cleaning operation, the clutch 408 can be disengaged but the system pump 15 can be maintained on to continue to drive the turbine 400 in order to drive the generator 412 for recharging the battery 416 via the switching circuit 414. By so operating the system, the battery 416 can remain sufficiently charged to drive the motor 412 during normal cleaning to assist the turbine in driving the propulsion system 410. At the conclusion of the cleaning operation, the battery 416 is then recharged in order to prepare the system for the next day's cleaning cycle.

From the foregoing, it should now be apparent that applicants have disclosed multiple embodiments of an automatic swimming pool cleaner system utilizing a body which is electrically propelled and is coupled via a hose to a suction source for cleaning. Although preferred embodiments of the invention include the capability of selectively cleaning at either the water surface or wall surface, other embodiments in accordance with the invention can be configured for cleaning operation solely at the wall surface.

It is of course recognized that variations and modifications of the embodiments described herein can readily be made by those skilled in the art without departing from the spirit and scope of the present invention.

We claim:

1. Apparatus for cleaning the surface of a wall containing a water pool and/or the surface of said water pool, said apparatus comprising:

a cleaner body;

a propulsion subsystem carried by said body for moving said body along a path adjacent to said wall surface and/or water surface;

a cleaning subsystem carried by said body for collecting pool water as it moves along said path;

an electric power source for supplying electric power to at least one of said subsystems;

a suction power source for supplying suction power to at least one of said subsystems; and a level control subsystem carried by said body for producing a vertical force to selectively place said body either (1) proximate to said wall surface or (2) proximate to said water pool surface.

2. The apparatus of claim 1 wherein said cleaning subsystem includes a water flow path coupling a water inlet on said body to a water outlet on said body; and a hose coupling said suction power source to said water outlet for drawing pool water into said water inlet.

3. The apparatus of claim 2 wherein said water inlet is located on said body to be in close proximity to said wall surface as said body moves along said path adjacent to said wall surface.

4. The apparatus of claim 2 including a debris collection container for removing debris from water flowing along said water flow path.

5. The apparatus of claim 2 including a turbine carried by said body and mounted to be driven by water flow between said water inlet and said water outlet.

6. The apparatus of claim 5 wherein said electric power source includes a battery carried by said body; and wherein said electric generator supplies electric power for charging said battery.

7. The apparatus of claim 1 wherein said propulsion subsystem includes a motor; and a flow generator driven by said motor for discharging a water flow from said body to produce a force acting to move said body in a first direction along said path.

8. The apparatus of claim 7 wherein said propulsion subsystem includes means for selectively redirecting said body to move in a second direction different from said first direction.

9. The apparatus of claim 8 further including means for sensing the motion of said body; and wherein said means for redirecting is responsive to the sensed motion of said body.

10. The apparatus of claim 1 wherein said propulsion subsystem includes a motor; and traction means carried by said body and driven by said motor for engaging said wall surface to propel said body in a first direction along said path.

11. The apparatus of claim 10 wherein said propulsion subsystem includes means for selectively propelling said body in a second direction different from said first direction.

12. The apparatus of claim 1 including a wire coupling said electric power source to said body.

13. The apparatus of claim 1 wherein said electric power source includes a rechargeable battery carried by said body.

14. The apparatus of claim 13 further including a docking station mounted proximate to said wall and having electric terminals configured to recharge said battery.

15. The apparatus of claim 1 wherein said electric power source includes a solar cell mounted on said body.

16. The apparatus of claim 1 wherein said electric power source includes an electric generator carried by said body.

17. The apparatus of claim 16 including a first inlet on said body located to collect water from said water pool surface and a second inlet on said body located to collect water from said wall surface;

at least one outlet on said body;

a flow path coupling said inlets to said outlet; and means coupling said suction power source to said outlet for pulling water into said inlets.

18. The apparatus of claim 1 wherein said propulsion subsystem moves said body along a path proximate to said water pool surface when said body is placed proximate to said water pool surface.

19. The apparatus of claim 18 including a debris collection container for removing debris from water flowing along said water flow path.

20. The apparatus of claim 19 including an electric generator carried by said body; and wherein said turbine is configured to drive said electric generator to supply electric power.

21. The apparatus of claim 19 wherein said turbine is configured to drive said propulsion subsystem for moving said body.

22. The apparatus of claim 1 further including a steering subsystem carried by said body for applying a steering force to said body.

23. The apparatus of claim 22 including a valve located between said inlets and said outlet for adjusting the relative flow through said first and second inlets dependent upon whether the body is proximate to said wall surface or said water pool surface.

24. The apparatus of claim 1 further including a controller for causing said level control subsystem to place said body either proximate to said wall surface or proximate to said water pool surface;

event sensor means; and wherein said controller is responsive to said event sensor means.

25. The apparatus of claim 1 further including a controller for causing said level control subsystem to place said body either proximate to said wall surface or proximate to said water pool surface;

user input means: and wherein said controller is responsive to said user input means.

26. The apparatus of claim 1 wherein said cleaning subsystem includes a flow generator powered by said electric power source.

27. The apparatus of claim 1 wherein said cleaning subsystem includes a water inlet on said body; and a flow generator driven by said electric power source for drawing pool water into said water inlet.

28. The apparatus of claim 27 including a debris collection container for removing debris from water flowing into said water inlet.

29. The apparatus of claim 1 wherein said cleaning subsystem includes a water flow path coupling a water inlet on said body to a water outlet on said body;

a hose coupling said suction power source to said water outlet for drawing pool water into said water inlet; and wherein said inlet is located on said body to be in close proximity to said water pool surface when said body is placed proximate to said water pool surface.

30. Apparatus for cleaning the surface of a wall containing a water pool and/or the water surface of said pool, said apparatus comprising:

a cleaner body;

a propulsion subsystem carried by said body for moving said body along a path adjacent to said wall surface and/or said water surface;

a cleaning subsystem carried by said body for collecting pool water as it moves along said path;

an electric power source for supplying electric power to at least one of said subsystems; and a pump located externally of said water pool for supplying suction power to at least one of said subsystems via a hose coupled to said body for drawing pool water therethrough.

31. The apparatus of claim 30 wherein said propulsion subsystem includes a motor; and a flow generator driven by said motor for discharging a water flow from said body to produce a force acting to move said body in a first direction along said path.

32. The apparatus of claim 31 wherein said propulsion subsystem includes means for selectively redirecting said body to move in a second direction different from said first direction.

33. The apparatus of claim 32 further including means for sensing the motion of said body; and wherein said means for redirecting is responsive to the sensed motion of said body.

34. The apparatus of claim 30 wherein said propulsion subsystem includes a motor; and traction means carried by said body and driven by said motor for engaging said wall surface to propel said body in a first direction along said path.

35. The apparatus of claim 30 wherein said propulsion subsystem includes means for selectively propelling said body in a second direction different from said first direction.

36. The apparatus of claim 30 including a wire coupling said electric power source to said body.

37. The apparatus of claim 30 wherein said electric power source includes a rechargeable battery carried by said body.

38. The apparatus of claim 37 further including a docking station mounted proximate to said wall and having electric terminals configured to recharge said battery.

39. The apparatus of claim 30 wherein said electric power source includes a solar cell mounted on said body.

40. The apparatus of claim 30 wherein said electric power source includes an electric generator carried by said body.

41. The apparatus of claim 30 including a turbine carried by said body and mounted to be driven by pool water drawn through said body.

42. The apparatus of claim 41 including an electric generator carried by said body; and wherein said turbine is configured to drive said electric generator to supply electric power.

43. The apparatus of claim 30 wherein said cleaning subsystem includes a water inlet on said body; and a flow generator driven by said electric power source for drawing pool water into said water inlet.

44. The apparatus of claim 43 including a debris collection container for removing debris from water flowing into said water inlet.

* * * * *